US011548772B2

(12) United States Patent
McKinney et al.

(10) Patent No.: US 11,548,772 B2
(45) Date of Patent: Jan. 10, 2023

(54) LIQUID TRANSFER DEVICE AND METHOD OF USE

(71) Applicants: Kevin D. McKinney, LaPorte, IN (US); Theresa M. McKinney, LaPorte, IN (US)

(72) Inventors: Kevin D. McKinney, LaPorte, IN (US); Theresa M. McKinney, LaPorte, IN (US)

( * ) Notice: Subject to any disclaimer, the term of this patent is extended or adjusted under 35 U.S.C. 154(b) by 196 days.

(21) Appl. No.: 16/851,887

(22) Filed: Apr. 17, 2020

(65) Prior Publication Data

US 2020/0331742 A1 Oct. 22, 2020

Related U.S. Application Data

(60) Provisional application No. 62/835,092, filed on Apr. 17, 2019.

(51) Int. Cl.
*B67C 9/00* (2006.01)
*B65D 43/02* (2006.01)
*B65D 51/24* (2006.01)

(52) U.S. Cl.
CPC ..... *B67C 9/00* (2013.01); *B65D 43/0231* (2013.01); *B65D 51/24* (2013.01)

(58) Field of Classification Search
CPC ..... B65D 43/0231; B65D 51/24
USPC ..... 141/363–366
See application file for complete search history.

(56) References Cited

U.S. PATENT DOCUMENTS 3,945,617 A * 3/1976 Callery ..... B01F 35/71 215/DIG. 8
5,490,545 A * 2/1996 Sokoloff ..... A63F 7/045 138/40
6,418,987 B1 * 7/2002 Colasacco ..... B65B 39/001 141/366
6,470,928 B1 * 10/2002 Davis ..... B65B 39/002 141/301

* cited by examiner

*Primary Examiner* — Jason K Niesz
(74) *Attorney, Agent, or Firm* — Hartman Global IP Law; Gary M. Hartman; Domenica N. S. Hartman

(57) ABSTRACT

A device for transferring liquids from between containers, and methods for its use. The device includes a body having an axis and first and second cap members at oppositely-disposed axial ends of the body. Cavities are present within the first and second cap members and define axial openings in the body. The cavities are coaxially aligned along the axis of the body and define interior walls within the first and second cap members on which female threads are formed. At least one fluid passage is within the body and fluidically interconnects the cavities. The axial openings in the body are configured to receive necks of first and second containers, and the female threads are configured to couple with male threads on the necks of the first and second containers such that the device physically couples the first and second containers together.

9 Claims, 3 Drawing Sheets

LIQUID TRANSFER DEVICE AND METHOD OF USE

CROSS-REFERENCE TO RELATED APPLICATIONS

This application claims the benefit of U.S. Provisional Application No. 62/835,092 filed Apr. 17, 2019, the contents of which are incorporated herein by reference.

BACKGROUND OF THE INVENTION

The present invention generally relates to liquid containers and their use. The invention particularly relates to devices for assisting in the transfer of a liquid from one container to another.

There are occasions when it is necessary or desirable to transfer a liquid from one container, such as a bottle or the like, to another, as an example, to consolidate the liquids in multiple partially-filled containers into a single container. As a nonlimiting example, it may be desirable to combine liquid hand soap from two partially filled bottles into a single bottle to save space and avoid difficulties when dispensing the soap when at low levels in a container equipped with a pump dispenser. Traditionally, transfer of liquids between such containers can be achieved with the use of a funnel or similar device. However, contact between the funnel and the liquid often leads to waste since at least some of the liquid will likely remain on the funnel and require cleaning. This is especially an issue for relatively viscous liquids such as hand soaps, which typically leave a thick film on the funnel. During the transfer process, the funnel and containers may be unstable, necessitating that the user stabilize the funnel, the container from which the liquid is being dispensed, and the container to which the liquid is being transferred to prevent tipping of the containers and spilling of the liquid.

In view of the above, it would be desirable if a device were available that was capable of facilitating the process of transferring liquids between containers.

BRIEF DESCRIPTION OF THE INVENTION

The present invention provides devices suitable for transfer of liquids from one container to another.

According to one aspect of the invention, a liquid transfer device includes a body having an axis and first and second cap members at oppositely-disposed axial ends of the body. First and second cavities are present within the first and second cap members and define first and second axial openings in the body. The first and second cavities are coaxially aligned along the axis of the body and define interior walls within the first and second cap members on which first and second female threads are formed, respectively. At least one fluid passage is within the body and fluidically interconnects the first and second cavities. The first and second axial openings in the body are configured to receive necks of first and second containers, and the first and second female threads are configured to couple with male threads on the necks of the first and second containers such that the liquid transfer device physically couples the first and second containers together, coaxially aligns the first and second containers with the axis of the body, and fluidically connects fluid reservoirs within the first and second containers through the fluid passage of the body.

Another aspect of the invention is a method of using the liquid transfer device described above to transfer a liquid from a first container to a second container. Such a method may include threadably coupling the first cap member of the liquid transfer device to the neck of the first container and threadably coupling the second cap member of the liquid transfer device to the neck of the second container to yield an assembly in which the first and second female threads of the liquid transfer device are threadably coupled with the male threads on the necks of the first and second containers and the liquid transfer device physically couples the first and second containers together, coaxially aligns the first and second containers with the axis of the body, and fluidically connects the fluid reservoirs within the first and second containers through the fluid passage of the body. Thereafter, the first and second containers are oriented such that the first container is above the second container and a liquid within the first container flows solely by gravity from the reservoir of the first container, through the fluid passage of the liquid transfer device, and into the reservoir of the second container.

Technical effects of the device and method described above preferably include the ability to transfer liquids between containers conveniently with reduced waste and without the requirement to hold the containers or the device during the transfer process.

Other aspects and advantages of this invention will be appreciated from the following detailed description.

DETAILED DESCRIPTION OF THE INVENTION

Figure 1:
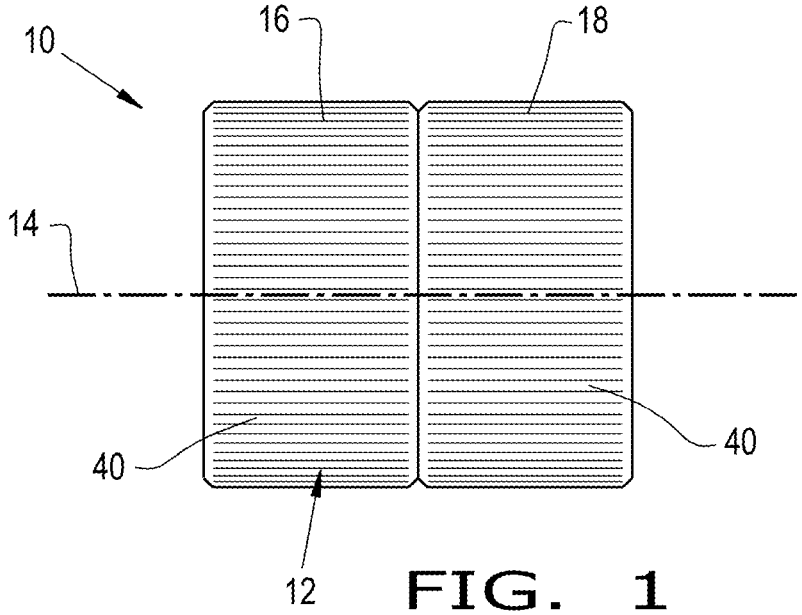
FIG. 1 is a side view of a liquid transfer device in accordance with a nonlimiting embodiment of this invention.
Figure 2:
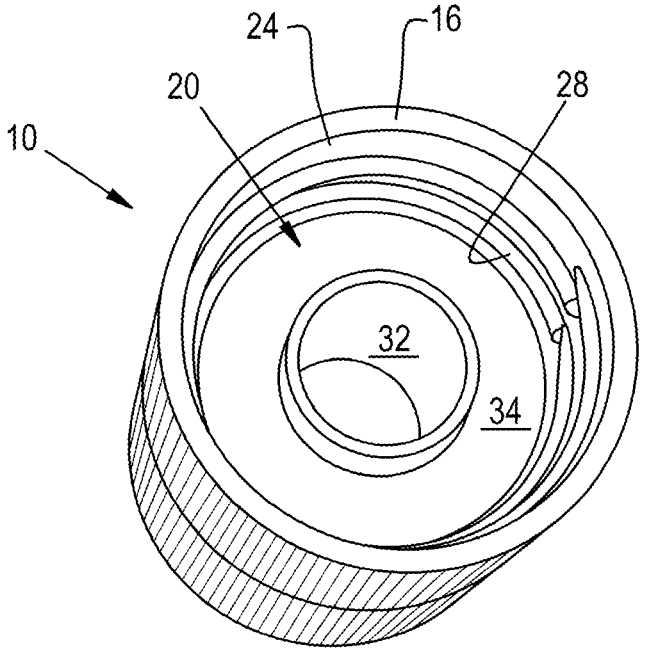
FIGS. 2 and 3 are end views depicting oppositely-disposed axial ends of the liquid transfer device of FIG. 1.
Figure 3:
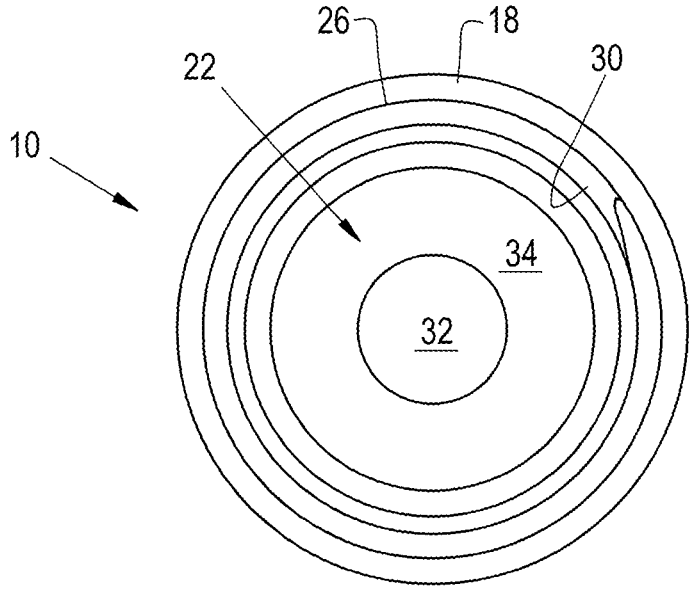

FIGS. 1 through 3 schematically represent a nonlimiting embodiment of a liquid transfer device 10. The device 10 includes a generally cylindrical body 12 that defines an axis 14 of the device 10. The body 12 comprises first and second cap members 16 and 18 that are disposed at opposite axial ends of the body 12. As seen in FIGS. 2 and 3, each cap member 16 and 18 defines an interior cavity 20 and 22, respectively, each defining an axial opening 24 and 26 at a respective axial end of the body 12. The cavities 20 and 22 are coaxially aligned along the axis 14 of the body 12 and define interior walls within the cap members 16 and 18 on which female threads 28 and 30, respectively, are formed. The female threads 28 and 30 may have identical or different diameters and thread pitches, depending on the types of containers for which the device 10 is intended to be used.

A fluid passage 32 within the body 12 fluidically interconnects the cavities 20 and 22 of the cap members 16 and 18. The passage 32 is represented as a single hole that coincides with the axis 14 of the body 12, though it is foreseeable that the passage 32 could comprise multiple holes, some or all of which do not lie on the axis 14. The passage 32 has an interior diameter that is smaller than interior diameters of each of the cavities 20 and 22, for example, roughly one-half the diameter of each cavity 20 and 22, though smaller and larger diameters are foreseeable for the passage 32.

The passage 32 is shown as being defined in a divider 34 that is between and separates the cavities 20 and 22 of the cap members 16 and 18. In the nonlimiting embodiment shown, the divider 34 is located approximately midway between the axial ends of the body 12 and formed by abutting axial walls of the cap members 16 and 18, and the passage 32 is defined by a tube that passes through the divider 34 and whose opposite ends are flared to secure the cap members 16 and 18 to the tube. With this configuration, the tube can rotatably couple the cap members 16 and 18 to each other, effectively serving as an axle that enables the cap members 16 and 18 to rotate about the axis 14 independently of each other. However, it is foreseeable that the divider 34 could be located nearer to one axial end of the body 12 than the opposite end, and/or the divider 34 could be formed by a single wall, and/or the passage 32 could be defined by a hole through the divider 34. If formed by a single wall, the divider 34 rigidly fixes the cap members 16 and 18 relative to one another to prevent their rotation relative to each other.

Figure 4:
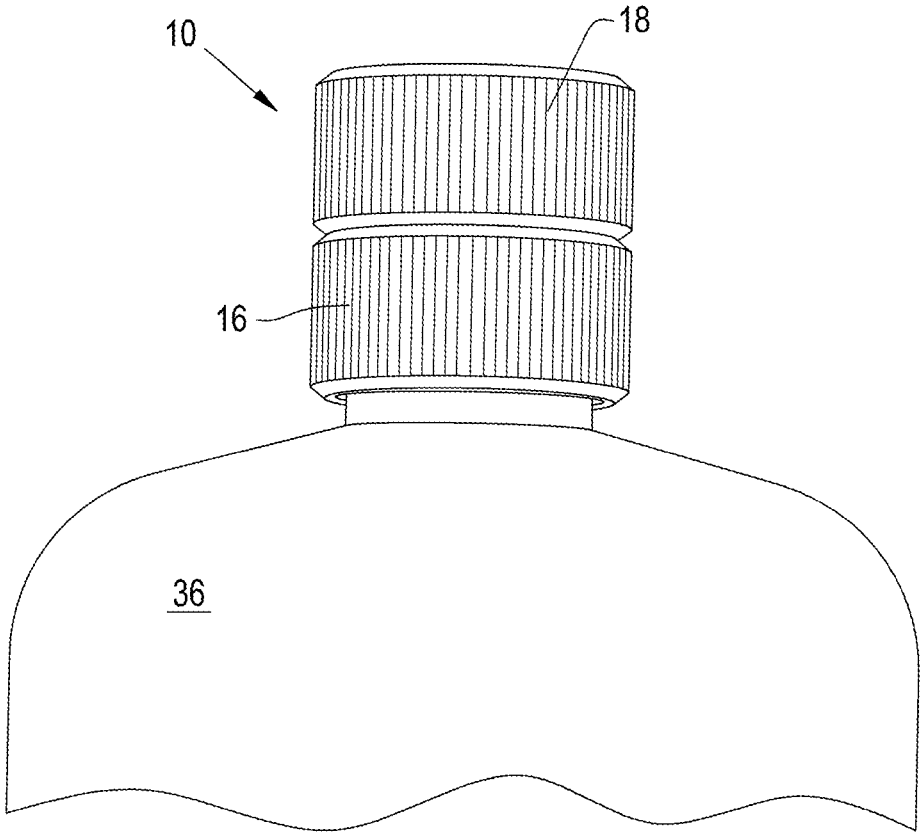
FIG. 4 depicts the liquid transfer device of FIGS. 1 through 3 secured to a first container.
Figure 5:
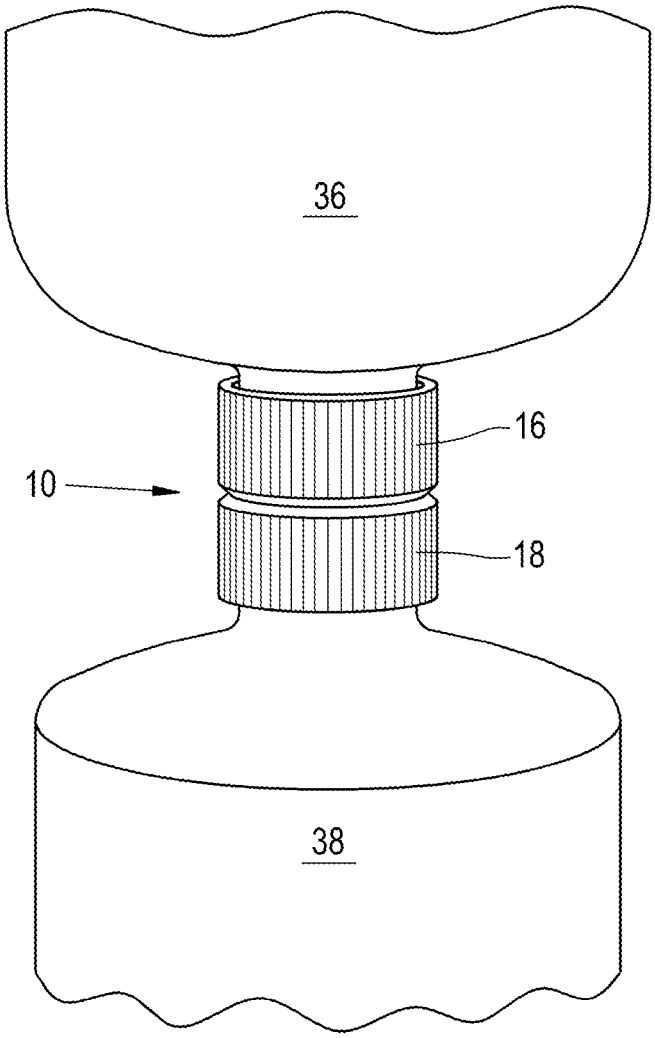
FIG. 5 depicts the liquid transfer device further secured to a second container and oriented for transferring a liquid from the first container to the second container.

The female threads 26 and 28 on interior surfaces of the cap members 16 and 18 are configured to couple with male threads of corresponding liquid containers, for example, conventional screw cap bottles widely used as containers for consumer and industrial products. FIGS. 4 and 5 depict nonlimiting examples of conventional bottles 36 and 38 that are physically and fluidically coupled to each other with the device 10 of FIGS. 1 through 3 for the purpose of transferring a liquid from one bottle to the other. As a nonlimiting example, the liquid may be a hand soap, shampoo, lotion, cooking oil, or the like. The neck of each bottle 36 and 38 has male threads (not shown) sized and configured to be threadably engaged with the female threads 26 and 28 of one or either of the cap members 16 and 18.

FIGS. 4 and 5 generally represent steps for using the device 10 to transfer a liquid between the two bottles 36 and 38. To facilitate a description of this process as represented in FIGS. 4 and 5, relative terms may be used in reference to the orientations of the device 10 and bottles 36 and 38 secured thereto during their use. All such relative terms are intended to indicate the installation and use of the device 10 and therefore help to define the scope of the invention.

In FIG. 5, a cap has been removed from the bottle 36 to expose male threads (not shown) on a neck of the bottle 36, and the cap member 16 has been threaded onto the male threads of the bottle 36 in place of the removed cap. The cap member 18 extends away from the bottle 36, enabling the second bottle 38 to be coupled to the first bottle 36 with the device 10 as shown in FIG. 6. Coupling of the second bottle 38 can be facilitated if the device 10 is configured so that the cap members 16 and 18 are rotatably coupled to each other with a tube, as described above. The exterior surface of each cap member 16 and 18 is represented in the drawings as including ridges 40 similar to those used on screw-on bottle caps to improve a user's grip. It is foreseeable and within the scope of the invention that the exterior surfaces of the cap members 16 and 18 may include other surface features, for example, planar surfaces that define a hexagonal outer shape on each cap member 16 and 18 that enables the device 10 to be threaded onto and removed from the bottles 36 and 38 with a wrench or other tool.

In any event, the result is an assembly in which the female threads 28 and 30 of the liquid transfer device 10 are threadably coupled with the male threads on the necks of the bottles 36 and 38, and the device 10 physically couples the bottles 36 and 38 together, coaxially aligns the bottles 36 and 38 with the axis 14 of the body 12, and fluidically connects fluid reservoirs within the bottles 36 and 38 through the passage 32 of the body 12. By orienting the bottles 36 and 38 such that the bottle 36 is above the bottle 38, a liquid within the bottle 36 is able to flow solely by gravity from the reservoir of the lower bottle 36, through the fluid passage 32 of the device 10, and into the reservoir of the lower bottle 38. The lower bottle 38 may be stood on end such that it supports the upper bottle 36, which it supports in an upside-down position. The stability of the assembly is promoted as a result of the minimal axial length of the device 10, which consists entirely of the cap members 16 and 18 and the divider 34 therebetween. As an example, the total axial length of the device 10 may be less than two inches (less than about 5 cm).

Since both bottles 36 and 38 are secured to the device 10 and coaxially aligned with each other during transfer of the liquid, the assembly is generally stable and it will be likely unnecessary for a user to hold the bottles 36 and 38 or the device 10 during the transfer process, thus allowing for a hands-free transfer operation. As such, it is foreseeable that the bottles 36 and 38 may be left unattended during the transfer process. Furthermore, the cap members 16 and 18 and their threaded engagement with the bottles 36 and 38 provide fluid-tight connections that reduce the likelihood that the liquid will spill or leak in the event that the bottles 36 and 38 happen to tip or fall. The bottles 36 and 38 may remain coupled with the device 10 until essentially all of the liquid in the upper bottle 36 has been transferred to the lower bottle 38. Even if some liquid remains in the device 10, it is likely that the remaining amount will be significantly less than the amount that would remain on a funnel or similar device conventionally used to transfer fluids between containers. Once the device 10 is removed from both bottles 36 and 38, it may be cleaned, for example, by rinsing the device 10 under a faucet.

While the invention has been described in relation to consumer products, such as soaps, shampoos, lotions, cooking oils, and the like, it is foreseeable and within the scope of the invention that the teachings disclosed herein could be applicable to other applications in which a funnel might be used to transfer a liquid between containers, as nonlimiting examples, more industrial products such as motor oils, transmission fluids, brake fluids, gear oils, etc. As such, it will be understood that the size of the device 10 and its threads 28 and 30 and materials from which the device 10 is formed will depend on the particular application, the fluid being transferred, the sizes of the containers, and the sizes of the threads on the containers. Furthermore, the diameter of the passage 32 through the device 10 may be appropriately sized for the particular liquid to be transferred, for example, based on its viscosity or the presence of solids suspended in the liquid.

While the invention has been described in terms of particular embodiments, it is apparent that other forms could be adopted by one skilled in the art. For example, the liquid transfer device 10 and its components could differ in appearance and construction from the embodiments described herein and shown in the drawings, functions of certain components of the device could be performed by components of different construction but capable of a similar (though not necessarily equivalent) function, and various materials could be used in the manufacturing of the device 10 and its components. Accordingly, it should be understood that the invention is not necessarily limited to any embodiment described herein or shown in the drawings. It should also be understood that the phraseology and terminology employed above are for the purpose of describing the disclosed embodiments, and do not necessarily serve as limitations to the scope of the invention. Therefore, the scope of the invention is to be limited only by the following claims.

The invention claimed is:

1. A liquid transfer device comprising:

a body having an axis and first and second cap members disposed at oppositely-disposed axial ends of the body;

first and second cavities within the first and second cap members that define first and second axial openings in the body, the first and second cavities being coaxially aligned along the axis of the body and defining interior walls within the first and second cap members;

first and second female threads formed on the interior walls of, respectively, the first and second cap members;

a divider between and separating the first and second cavities of the body; and a tube passing through the divider and having flared ends that couple the first and second cap members together so that each of the first and second cap members rotate relative to the tube and the tube defines an axle of the body that rotatably couples the first and second cap members together, the tube defining at least one fluid passage therethrough that fluidically interconnects the first and second cavities, the at least one fluid passage being a continuous uninterruped hole through the tube that continuously fluidically connects the first and second cavities within the first and second cap members;

wherein the first and second axial openings in the body are configured to receive necks of first and second containers and the first and second female threads are configured to couple with male threads on the necks of the first and second containers such that the liquid transfer device physically couples the first and second containers together, coaxially aligns the first and second containers with the axis of the body, and fluidically connects fluid reservoirs within the first and second containers such that a liquid within the reservoir of the first container freeflows through the continuous uninterruped hole of the tube and into the reservoir of the second container.

2. The liquid transfer device of claim 1, wherein the fluid passage has an interior diameter that is smaller than interior diameters of the first and second cavities of the body.

3. The liquid transfer device of claim 1, wherein the divider comprises abutting walls of the first and second cap members.

4. The liquid transfer device of claim 1, wherein the first and second female threads have the same diameter and thread pitch.

5. The liquid transfer device of claim 1, wherein the first and second female threads have different diameters and/or thread pitches.

6. The liquid transfer device of claim 1, wherein the fluid passage coincides with the axis of the body.

7. A method of using the liquid transfer device of claim 1 to transfer a liquid from the first container to the second container, the method comprising:

threadably coupling the first cap member of the liquid transfer device to the neck of the first container and threadably coupling the second cap member of the liquid transfer device to the neck of the second container to yield an assembly in which the first and second female threads of the liquid transfer device are threadably coupled with the male threads on the necks of the first and second containers and the liquid transfer device physically couples the first and second containers together, coaxially aligns the first and second containers with the axis of the body, and fluidically connects the fluid reservoirs within the first and second containers through the fluid passage of the body; and orienting the first and second containers such that the first container is above the second container and a liquid within the first container flows solely by gravity from the reservoir of the first container, freeflows solely through the fluid passage of the liquid transfer device, and into the reservoir of the second container.

8. The method of claim 7, wherein the liquid is chosen from the group consisting of soaps, shampoos, lotions, and cooking oils.

9. The method of claim 7, wherein the liquid is chosen from the group consisting of motor oils, transmission fluids, brake fluids, and gear oils.

* * * * *